United States Patent [19]

Nagai et al.

[11] 4,448,809

[45] May 15, 1984

[54] METHOD OF SILVER PLATING STAINLESS STEEL VACUUM BOTTLE SURFACES

[75] Inventors: Kiyoshi Nagai, Nishinomiya; Hiroshi Shinohara, Nara; Nobuo Imamura, Matsubara, all of Japan

[73] Assignee: Taiyo Sanso Co., Ltd., Osaka, Japan

[21] Appl. No.: 429,890

[22] Filed: Sep. 30, 1982

[51] Int. Cl.[3] ..... B05D 7/22; B05D 7/14; C23C 3/02

[52] U.S. Cl. ..... 427/239; 427/125; 427/162; 427/304; 427/319; 427/437

[58] Field of Search ..... 427/437, 319, 304, 239, 427/162, 125

[56] References Cited

U.S. PATENT DOCUMENTS 2,698,813 1/1955 Koh ..... 427/319 X

*Primary Examiner*—James R. Hoffman

*Attorney, Agent, or Firm*—Griffin, Branigan & Butler

[57] ABSTRACT

A method of silver plating stainless steel vacuum bottle surfaces includes the steps of thermally treating the surfaces to be coated at a temperature of at least 200° C. and then using an electroless plating technique to silver plate the thermally treated surfaces. The thermal treatment can be as low as 200° C. if it occurs in an atmosphere of at least 5% hydrogen gas. If the thermal treatment occurs in a vacuum, however, the temperature must be at least 700° C.

6 Claims, 3 Drawing Figures

METHOD OF SILVER PLATING STAINLESS STEEL VACUUM BOTTLE SURFACES

BACKGROUND OF THE INVENTION

This invention relates to an improved method of silver-plating stainless steel vacuum bottle surfaces.

Vacuum bottles are conventionally comprised of spaced apart inner and outer bottles so that the volume therebetween can be evacuated to form a vacuum chamber for insulating the structure's contents against gas conduction.

Conventionally, one or both of the vacuum chamber walls are reflectorized in order to reduce radiation heat loss. This reflectorization is commonly accomplished by silvering or by aluminum or nickel plating or by precision-polishing the vacuum chamber walls in order to improve their reflectivity. In order to improve the durability of vacuum bottles, however, the bottles have been made of stainless steel or other metals. But it has been difficult to plate such stainless steel walls with silver, because existing techniques for electroless plating have tended to result in an overly thick coating of silver which is prone to containing defects even when the stainless steel surfaces are first chemically or mechanically treated.

Accordingly, aluminum or nickel plating and the like have been replacing silver plating even though silvered surfaces provide improved reflectivity.

It is an object of this invention, therefore, to provide a method for depositing very thin, uniform, defectless silver coating directly onto stainless steel vacuum chamber surfaces.

One method of depositing silver onto stainless steel vacuum chamber walls has been to first place a layer of glass on the stainless steel walls or to first plate the stainless steel with nickel or the like. These methods, however, add process steps to the manufacture or the vacuum bottle and result in higher manufacturing costs. Additionally, the thickness of the metal or glass plating layers provides additional locations for gas molecules which tend to degrade the vacuum in the vacuum chamber and increase heat losses caused by the transport of heat by those gas molecules. Accordingly, it is yet another object of the present invention to provide a method of silverplating stainless steel vacuum chamber walls wherein manufacturing costs are reduced without increasing heat losses by radiation and/or gas conduction.

SUMMARY

As a result of considerable testing at different temperatures and vacuums it has been found that stainless steel vacuum chamber walls can be electroless plated with silver provided they are first thermally treated with temperatures of higher than 700° C. and a vacuum of at least $1\times10^{-2}$ torr. When the electroless plating step was conducted after such a thermal treatment, the resulting coating was essentially defect free, had a uniform thin layer of silver; and, provided excellent reflectivity with good adherence to the stainless steel surface.

Testing in different atmospheres has also resulted in an alternative method wherein a heat treatment of as little as 200° C. provided adequate cleanliness for the subsequent electroless plating steps provided the heat treatment step occurred in a hydrogen gas atmosphere.

BRIEF DESCRIPTION OF THE DRAWINGS

The foregoing and other objects, features, and advantages of the invention will be apparent from the more specific description of preferred embodiments of the invention, as illustrated in the accompanying drawings in which reference characters refer to the same parts throughout different views. The drawings are not necessarily to scale, emphasis instead being placed upon illustrating principles of the invention in a clear manner.

As shown in FIG. 1, a conventional stainless steel vacuum bottle is comprised of an inner container 1 that is spaced apart from an outer container 2 to form a vacuum chamber 6 between the two stainless steel containers 1 and 2.

Figure 1:
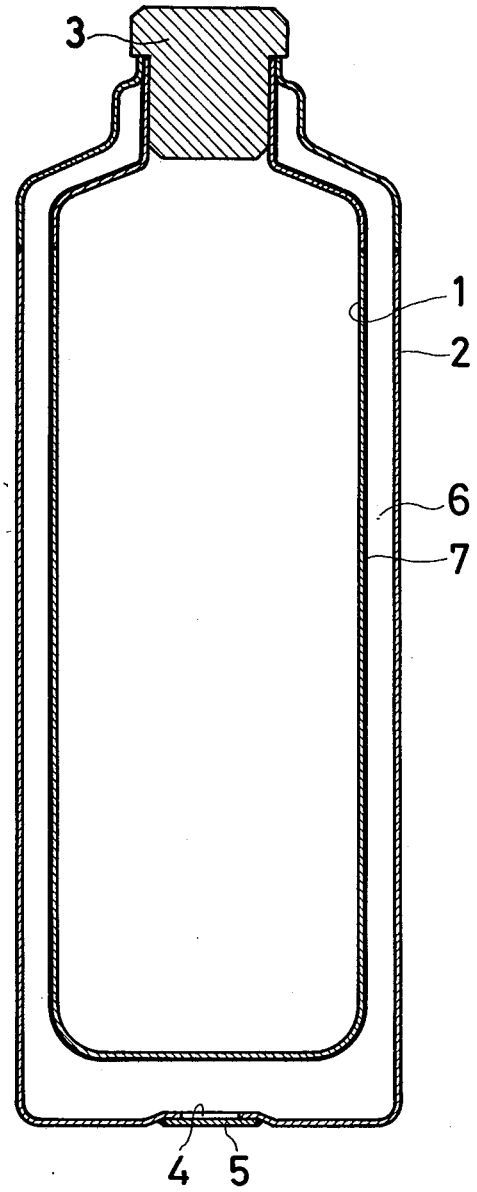
FIG. 1 is a diagrammatic vertical sectional view of the vacuum bottle on which the method of the invention is performed.

One embodiment of such a vacuum bottle employs SUS 304 stainless steel plate of about 0.5 mm thickness.

A hole 4 is cut into the bottom of the outer container to permit evacuation of the chamber 6; and, after such evacuation the hole is sealed by a plate 5. A thermally insulating plug 3 is conventionally used to stopper the vessel's neck.

One or both of the vacuum chamber walls are customarily coated with a reflective material 7 which is preferably silver because its high reflectivity results in desirable reductions in radiation heat losses. In this respect, the silvered coating is often formed only on the exterior of the inner container 1, but both of the vacuum chamber walls are sometimes coated.

Figure 2:
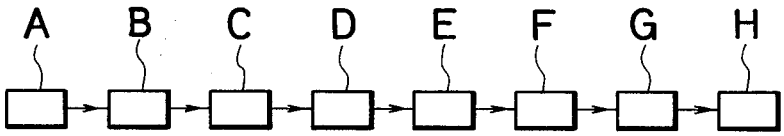
FIG. 2 is a flow chart illustrating a first embodiment of the method of the invention.
Figure 3:
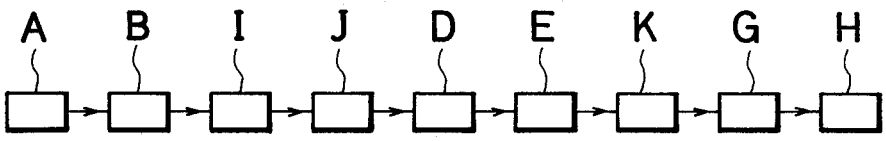
FIG. 3 is a flow chart of a second embodiment of the method of the invention.

As shown in FIGS. 2 and 3, the method of the invention includes first the formation of the inner and outer containers 1 and 2 (step A). The structures are then chemically cleansed in a conventional manner to include steps such as degreasing and the like as in step B.

The structures are then subjected to a thermal treatment. In step C of the FIG. 2 embodiment this includes a heat treatment in a vacuum furnace at a temperature in excess of at least 700° C. and a vacuum of at least $10^{-2}$ torr for about 30–60 minutes. In this respect, it is critical that temperatures higher than 700° C. be used because lower temperatures can result in subsequently applied silver layers being thick or uneven or having defects therein. Similarly, an undesirable silver coating results if the vacuum is less than $10^{-2}$ torr. A vacuum of greater than $10^{-2}$ torr is required in order for there to be effective surface cleaning for the subsequent silver coating step to be satisfactory.

In the above regard, the step C heat treatment results in the stainless steel surfaces becoming almost perfectly clean—at least in the sense that they have a higher degree of cleanliness than has been able to be obtained with conventional chemical or mechanical cleaning treatments such as pickling or buffing. Moreover, the outgasing that occurs during the heat treatment removes gas molecules that are adsorbed on the stainless steel surfaces. In fact, the cleaning that occurs during the heat treatment step is so complete that the step B chemical cleaning can be eliminated without significant detriment to the overall process.

After heat treatment the method includes an optional rinsing step (D) wherein the inner and outer containers are rinsed in a conventional tin solution containing a similarly conventional hydrating agent. One such tin solution is sold as "RBL" solution by the London Laboratory (located in the United States) and a suitable such hydrating agent is designated as "RNA" solution by London Laboratory.

Whichever type of tin solution and hydrating agent are used during the rinsing step D, the function of the step is to provide tin molecules on the surface of the stainless steel to act as nuclei to which the silver will adhere during the plating step in order to obtain easier formation and better bondability of the silver coating. As noted above, however, rinsing step D is not mandatory because excellent formation and adhesion of a silver coating is achieved whether or not the rinsing step D takes place.

After the rinsing step (if such a step is used) the stainless steel containers are subjected to an electroless silver-plating process (step E).

A "double-liquid" type of electroless silver plating bath is comprised of both a silver solution and a reducing solution that are mixed in the ratio of 1:1 to make up the plating solution. A suitable such silver solution is comprised of:

Silver Nitrate: 3.5 g
Aqueous ammonia: an amount sufficient to cause redissolution of precipitates
Water: 60 ml
Sodium hydroxide: 2.5 g A suitable reducing solution is comprised of:

Grape sugar: 4.5 g
Tartaric acid: 4 g
Alcohol: 100 ml
Water: 1000 ml

As the aqueous ammonia is added to the 3.5 g of silver nitrate, a precipitate will form. Addition of aqueous ammonia is continued, however, until the precipitate is redissolved.

Next, the 2.5 g of sodium hydroxide and the 60 ml of water are added to 60 ml of the above-described silver nitrate-aqueous ammonia solution. The resulting mixture can be expected to darken, but aqueous ammonia is then again added until the darkened solution becomes clear.

The reducing solution is prepared by dissolving the 4.5 g of grape sugar and the 4 g of tartaric acid in 1000 ml of water. This mixture is boiled for about 10 minutes and then cooled to room temperature after which the 100 ml of alcohol is added.

The silver solution and the reducing solution are then mixed together in their 1:1 ratio and maintained at 15° C.–30° C. If only the inner container is to be silver-coated, it is dipped into this double liquid solution for one to two minutes to permit formation of a silver coating which will adhere in a thin, very uniform thickness on the exterior surface of the inner container.

If it is also desired that the inner surface of the outer container be silver-plated, the plating solution at the prescribed temperature is poured into the outer container and maintained there for one to two minutes to form a similarily adhered uniform coating of silver.

The plating step (E) can also be performed with other conventional double-liquid types of plating solutions regardless of their components. Double-liquid plating solution ingredients identified by London Laboratory, for example, as ATS and ATA can be mixed in 1:1 proportions and used at the same temperatures and for the same durations noted above in order to obtain satisfactory results.

Moreover, conventional triple-liquid types of plating solutions can also be used. That is, a small amount of a common neutralizing solution can be added to a reducing-solution/silver-solution mixture that has been mixed in the ratio of 1:1. One such neutralizing solution is identified as "KDR" by London Laboratory; and, other suitable silver and reducing solutions from the same source are identified as "MS-1L" and "MA-260L" respectively. A satisfactory formulation for that particular triple-liquid type of plating solution has been the addition of 20 cc of MS-1L and 20 cc of MA-260L to 200 cc of water. 10 cc of KDR are then added to another 200 cc of water and all of the ingredients are then mixed together to form the triple-liquid plating solution.

After formulation of the triple-liquid plating solution as noted above, the surfaces to be silver-coated are soaked in the triple-liquid solution at 15°–30° C. for one to two minutes until the desired uniform thickness of silver is adhered to the surfaces to be plated.

After the plating in step (E), the FIG. 2 method includes a conventional brief water wash step (F) prior to fabrication into the container of FIG. 1 and a postheat treatment step (G).

The postheat treatment step is also performed in a conventional manner at a relatively low temperature in order to prevent degradation of the silver coating, but sufficient to cause outgasing of the gas molecules that are adsorbed onto the container's surfaces during the plating step. In this respect, the vacuum of the space 6 is maintained at a relatively high vacuum of about $10^{-3}$–$10^{-5}$ torr in order to better effect such outgasing.

The final step of the FIG. 2 process includes a conventional sealing step wherein the vacuum chamber 6 (FIG. 1) is conventionally sealed to maintain its vacuum. In this regard, the sealing step can conveniently occur in the same furnace as the postheat treatment step and include the customary closure of the evacuation hole 4 in the bottom of the outer container 2 by a sealing plate 5; but other types of sealing can also be used.

The container formation step and the optional chemical cleaning step of the FIG. 3 embodiment are the same as described above in connection with FIG. 2. Hence, they will not be further discussed.

Preheat treatment step I and hydrogen heat treatment step J, however, are substituted for the FIG. 3 heat treatment step C and will now be discussed in detail.

The FIG. 3 preheat treatment step I includes a soak in a vacuum furnace for about 5–20 minutes at a temperature of 100° C.–700° C. in a vacuum of at least $10^{-1}$ torr. This preheat treatment step (I), however, is merely optional and can be omitted if desired.

The preheat treatment step I, if employed, is followed by a hydrogen heating step which can occur in the same furnace as the preheat treatment step. The atmosphere of the furnace, however, is comprised of more than 5% hydrogen gas and the remainder (less than 95%) is inert gas at a temperature of at least 200° C. and less than about 700° C. The inner and/or outer containers 1 and 2 are maintained in this atmosphere at the stated temperature for about 20–60 minutes. During this time, the stainless steel surfaces become almost perfectly clean. That is, they achieve an extremely high degree of cleanliness that cannot be achieved with chemical or mechanical cleansing treatments such as pickling or buffing operations.

As in the FIG. 2 embodiment the rinsing step D, can be included or omitted as desired. If included, however, it is performed in the manner discussed in connection with the FIG. 2 embodiment.

After the rinsing step D, if used, the containers 1 and 2 are transferred to the plating apparatus in connection with step E where either the dual-liquid or triple-liquid method are employed in the same manner as discussed above.

The FIG. 3 embodiment includes a post-rinsing step K wherein the silver-plated surfaces are rinsed with a conventional post-plating rinsing solution. One such solution is comprised of pure water that is used to dilute a conventional silver-rinsing agent such as that sold under the identification of RNA by London Laboratory.

The plated and rinsed container surfaces are then subjected to postheat treatment and sealing steps G and H in the manner described above in connection with FIG. 2. In this respect, the temperature is maintained relatively low because of the heat sensitivity of the silver coating; and, the high degree of vacuum is employed in order to essentially completely outgas the gas molecules that are adsorbed onto the container surfaces during plating.

The two embodiments of the invention described provide a very thin, defect-free layer of silver that is of uniform thickness. In this respect, either of the two embodiments is far superior to conventional hydrochloric acid or ultra-sonic cleaning methods wherein subsequent electroless silver-deposition methods in either double-liquid or triple-liquid forms often result in thick, uneven, defective coatings of silver that have poor adherence and low reflectivity. Accordingly, the method of the invention is generally much more efficient and results in a superior, more durable product. In fact, insofar as reflectivity is concerned, the reflectivity of the silver coating that is provided by the method of the invention is about the same or better as that which is obtained when silver is plated onto glass.

Comparative tests were conducted between vacuum bottles made in accordance with the instant invention and those made in accordance with conventional methods. In this regard, the bottles were all constructed of 0.5 mm stainless steel. The diameter of the outer containers was 121 mm and the diameter of the inner container was 100 mm so that the thickness of the vacuum chamber was 10 mm. The height of the containers was such that the capacity of the vacuum bottles was 2.2 liters. Only the exterior surfaces of the inner containers were silver plated and the vacuum chamber sealing was conducted by electron-beam welding.

The bottles were each filled with 2.2 liters of water at 95° C. After 24 hours the water temperature in the containers fabricated in accordance with the invention was 67° C. The water in the conventional vacuum bottles having aluminum plating, however, was down to 62° C.–64° C. The resulting temperature difference of about 4° C.–5° C., therefore, resulted in a rather dramatic improvement of 14–18%.

Moreover, the silver plating methods of the invention reduce manufacturing costs considerably when compared with a method in which silver, if it is to be satisfactorily plated at all, must be plated onto glass, nickel plated surfaces, or the like.

The embodiments of the invention in which an exclusive property or privilege is claimed are defined by the following:

1. A method of silver plating stainless steel vacuum bottle surfaces including the steps of:

thermally treating the surfaces to be coated at a temperature of at least 700° C. in a vacuum furnace at a vacuum of at least $1\times10^{-2}$ torr; and, then using an electroless plating technique to plate silver onto said surface.

2. A method of silver plating stainless steel vacuum bottle surfaces including the steps of:

thermally treating the surfaces to be coated at a temperature of at least 200° C. in an atmosphere containing at least about 5% hydrogen gas and the remainder thereof comprised of an inert gas; and, then using an electroless plating technique to plate silver onto said surface.

3. The method of claim 1 wherein the electroless plating step includes a plating bath comprising a liquid mixture of a silver solution and a reducing solution.

4. Method of claim 1 wherein the electroless plating step includes a plating bath comprising a liquid mixture of a silver solution, a reducing solution and a neutralizing solution.

5. The method of claim 2 wherein the electroless plating step includes a plating bath comprising a liquid mixture of a silver solution and a reducing solution.

6. Method of claim 2 wherein the electroless plating step includes a plating bath comprising a liquid mixture of a silver solution, a reducing solution and a neutralizing solution.

* * * * *